US010818466B1

(12) United States Patent
Allen et al.

(10) Patent No.: US 10,818,466 B1
(45) Date of Patent: Oct. 27, 2020

(54) X-RAY TUBE AND CATHODE CUP WITH DEPOSITION SHIELD

(71) Applicant: GE Precision Healthcare LLC, Wauwatosa, WI (US)

(72) Inventors: Donald Robert Allen, Waukesha, WI (US); Sandhya Dammu, West Milwaukee, WI (US); Andrew Marconnet, West Milwaukee, WI (US); Gregory Steinlage, West Milwaukee, WI (US)

(73) Assignee: GE Precision Healthcare LLC, Wauwatosa, WI (US)

( * ) Notice: Subject to any disclaimer, the term of this patent is extended or adjusted under 35 U.S.C. 154(b) by 0 days.

(21) Appl. No.: 16/400,735

(22) Filed: May 1, 2019

(51) Int. Cl.
*H01J 35/06* (2006.01)

(52) U.S. Cl.
CPC ..... *H01J 35/066* (2019.05)

(58) Field of Classification Search
CPC ..... H01J 35/065; H01J 35/066
See application file for complete search history.

(56) References Cited

U.S. PATENT DOCUMENTS

| | | | | |
|---|---|---|---|---|
| 3,322,993 | A * | 5/1967 | Vinopal | H01J 7/186 313/553 |
| 5,509,045 | A * | 4/1996 | Kautz | H01J 35/20 378/121 |
| 5,672,085 | A | 9/1997 | Knudsen et al. | |
| 5,907,595 | A | 5/1999 | Sommerer | |
| 8,548,124 | B2 | 10/2013 | Hauttmann et al. | |
| 2005/0169766 | A1* | 8/2005 | Gallitognotta | B01J 20/3433 417/51 |
| 2015/0117617 | A1* | 4/2015 | Ishihara | H01J 3/06 378/138 |
| 2017/0213685 | A1* | 7/2017 | Kang | H01J 29/488 |

* cited by examiner

*Primary Examiner* — Chih-Cheng Kao
(74) *Attorney, Agent, or Firm* — Andrus Intellectual Property Law, LLP

(57) ABSTRACT

An x-ray tube includes an electron emitter and a cathode cup having a recess that holds the electron emitter. The recess has a bottom surface, and a shield is positioned in the recess between the electron emitter and the bottom surface. The shield is configured to receive deposited sublimated emitter material and to maintain the sublimated emitter material away from the electron emitter.

16 Claims, 3 Drawing Sheets

X-RAY TUBE AND CATHODE CUP WITH DEPOSITION SHIELD

BACKGROUND

The present disclosure generally relates to x-ray systems and, more particularly, to a cathode cup having a deposition shield.

Electron sources are employed in x-ray systems, such as tomography (CT) and cardiovascular (CV) systems. Electron sources usually comprise of thermionic emitters which emit electrons upon reaching a certain temperature. The filaments forming these thermionic emitters are made of metal with a high melting point, like tungsten, lanthanum, or their alloys.

Presently available medical x-ray tubes typically include a cathode assembly having an emitter fixed in a cup. The cathode assembly is oriented to face an anode, or target, which is typically a metal or composite structure. The space between the cathode and anode is evacuated. The cathode cup designed to produce a tailored electric potential distribution in the vacuum such that all electron trajectories are redirected from their initial divergent motion toward a focal spot on the anode surface.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one embodiment, an x-ray tube includes a cathode cup having a recess that holds an electron emitter. The recess has a bottom surface, and a shield is positioned in the recess between the electron emitter and the bottom surface. The shield is configured to receive deposited sublimated emitter material and to maintain the sublimated emitter material away from the electron emitter.

One embodiment of a cathode cup for an x-ray system includes a recess for holding an electron emitter, the recess having a bottom surface that faces the electron emitter when the electron emitter is held in the recess. A shield is positioned between the electron emitter and the bottom surface of the recess, wherein the shield is configured to receive deposited sublimated emitter material and to maintain the sublimated emitted material away from the electron emitter.

Various other features, objects, and advantages of the invention will be made apparent from the following description taken together with the drawings.

BRIEF DESCRIPTION OF THE DRAWINGS

The present disclosure is described with reference to the following Figures.

DETAILED DESCRIPTION

Figure 1:
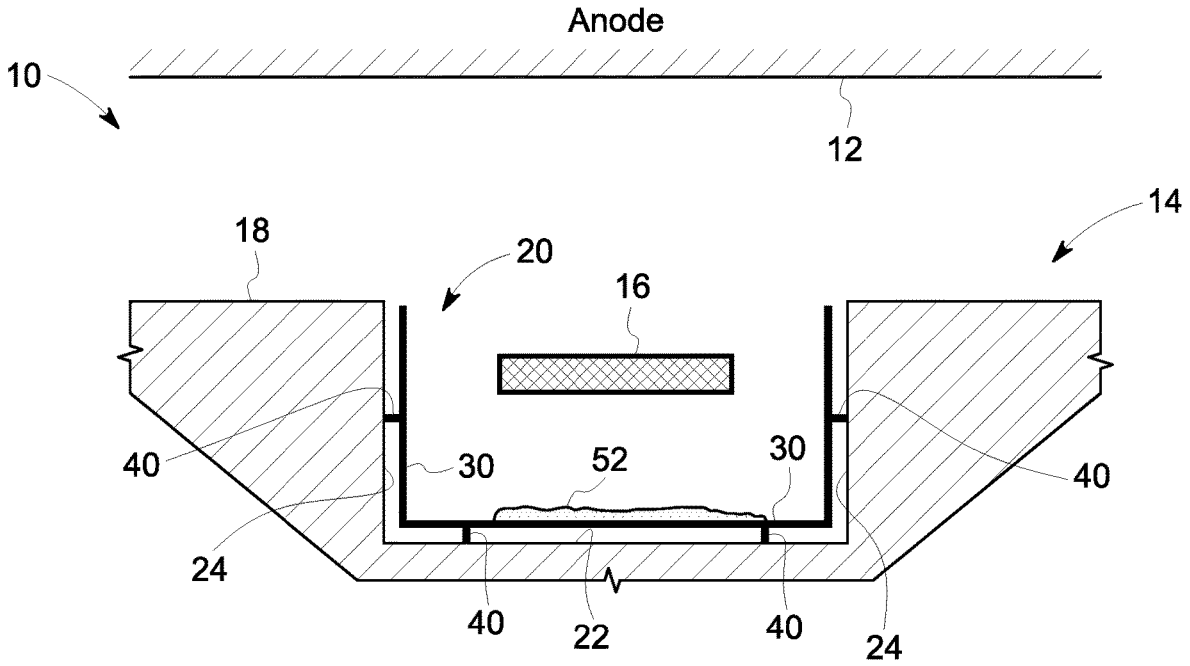
FIG. 1 is a cross-sectional view of an x-ray tube according to one embodiment of the disclosure.

The inventors have recognized a need for an improved cathode cup that better-maintains sublimated emitter material away from the electron emitter so as to reduce risk of emitter failure due to shorts caused by loose or flaking sublimated emitter material. Likewise, the inventors recognized a need for a cathode cup providing improved high voltage stability by reducing risk of loose sublimated emitter material in the high voltage gap between the emitter and the cathode cup.

Problems related to emitter sublimation and deposited emitter material within a cathode cup are well-known and long-existing in the relevant art. Sublimated, or evaporated, emitter material deposits onto the bottom of the cathode cup. For example, the deposited emitter material is often comprised of tungsten. The cathode cup is made from a different alloy than the deposited emitter material, so there is a thermal expansion mismatch. For example, cathode cups are typically made of nickel, molybdenum, Fe-41.5Ni (Ni42), Fe-29Ni-17Co (Kovar), or niobium.

The differences in the coefficient of thermal expansion (CTE) of the cathode cup and the deposited emitter material is problematic due to the high temperature fluctuation that occurs during the x-ray exposure time, which may be 400° C. or more at the surface of the cathode cup. Thermo-mechanical stress due to different thermal expansion coefficients often causes deposited emitter material to shear off of the bottom of the cathode cup and become loose within the area below the emitter, between a bottom side of the emitter and a bottom surface of the cathode cup. This separation usually starts at the borders of the deposited emitter material or at areas of uneven deposit.

Prior art solutions attempting to solve this problem have been inadequate. For example, one prior art solution is to texturize, or roughen, the bottom surface of the cathode cup to help adhesion between the deposited emitter material and the bottom surface of the cup. The increased adhesion between the materials can help withstand higher shearing forces. However, the inventors have recognized that solutions relating to texturizing the bottom surface of the cathode cup are insufficient to prevent the problem of loose emitter material contacting or getting too close to the electron emitter. Due to thermal expansion differences, such as differences in CTE between the deposited emitter material and the cathode cup mass, problematic flaking still occurs.

In view of the continued problem, and the problem with existing solutions recognized by the inventors, the inventors developed the disclosed cathode cup which comprises a deposition shield positioned between the electron emitter and the bottom surface of the cathode cup. As described herein, the shield 30 is a separate piece from the cathode cup, such as a mesh or a foil, inserted into the cathode cup and positioned between the emitter and the material of the cathode cup. The shield 30, being a separate piece, has a thermal expansion ability that is uncoupled from that of the cathode cup. The shield 30 is able to move separately from the cup and is generally not constrained by the thermal expansion of the cup, which is bulky and has a CTE that is very different from that of the deposited material.

In certain embodiments, the shield 30 may be comprised of a material that has the same or similar CTE as the deposited emitter material. For example, the shield may be a tungsten mesh or a tungsten foil, which could be a perforated foil. In such an embodiment, if the deposited emitter material is also tungsten, then the shield has a CTE that is equivalent to that of the deposited emitter material. In other embodiments, the shield 30 may be of a different refractory metal material, whereby the CTE of the shield 30 is still closer to that of the deposited emitter material than a typical cup material and thus reduces the strain induced by the thermal mismatch as compared to the previous embodiments where the deposited material adheres directly to the cathode cup.

The disclosed shield solutions developed by the inventors provides superior performance and reduces emitter failure. The disclosed cathode cup arrangement extends the lifetime of the emitter over existing cathode cup embodiments, including those providing a texturized coating, because the shield component is separate, and generally uncoupled, from the cathode cup and thus can stretch and deform without being overly constrained by the thermal properties of the bulky cathode cup architecture and material.

FIG. 1 depicts a cross-section of an exemplary x-ray system 10, which includes a cathode 14 that acts as an electron source and an anode 12. The cathode 14 comprises an emitter 16 and a cathode cup 18 that holds the emitter 16. The cathode cup may be made of any material, such as nickel, molybdenum, Ni42, Kovar, or niobium. The cathode cup 18 is positioned within the recess 20 such that the cathode cup acts as an electron focusing element to guide electrons from the emitter 16 toward the anode 12. In various embodiments, the emitter 16 may be a plate, a coil, a filament, or other type of emitting device known in the relevant art. The emitter 16 may be parallel to the bottom surface 22 of the recess 20 or may be angled at any angle with respect to the bottom surface 22.

The recess 20 is formed in the material of the cathode cup 18. The recess 20 includes a bottom surface 22 that faces the emitter 16. The recess may have one or more sidewalls 24, which may be perpendicular to the bottom surface 22, or at any angle thereto. Alternatively, the recess 20 may be bowl-shaped or otherwise have a curved bottom surface 22.

The shield 30 is positioned between the bottom surface 22 of the recess 20 and the emitter 16 and is configured to receive deposited emitter material 52, which results from sublimation of the emitter material during the high voltage exposure and electron emission. In various embodiments, the shield 30 may be a solid foil or sheet that gets mechanically attached to the cathode cup 18. In other examples, the shield 30 may be porous or perforated, such as a perforated sheet or a mesh.

In the depicted example, the shield 30 is mechanically attached to the bottom surface 22 and the sidewalls 24 the recess 20 via mechanical fixation means 40. In various embodiments, the mechanical fixation means 40 may be any mechanical device or element within the formation of the recess 20 of the cathode cup 18 or formation of the shield 30. As shown in various examples, the fixation means 40 may be a ledge 26 or groove 25 formed in the cup material. In alternative embodiments, the mechanical fixation means 40 may be provided by a formation in the shield 30, such as a rivet or swaged ridge, that provides a friction fit or a snap fit within the recess 20. In still other embodiments, the mechanical fixation means 40 may be any one of a screw, a tack, a weld, a clip, a spit pin, a snap, or other element that connects the shield 30 to the cathode cup 18.

Figure 2:
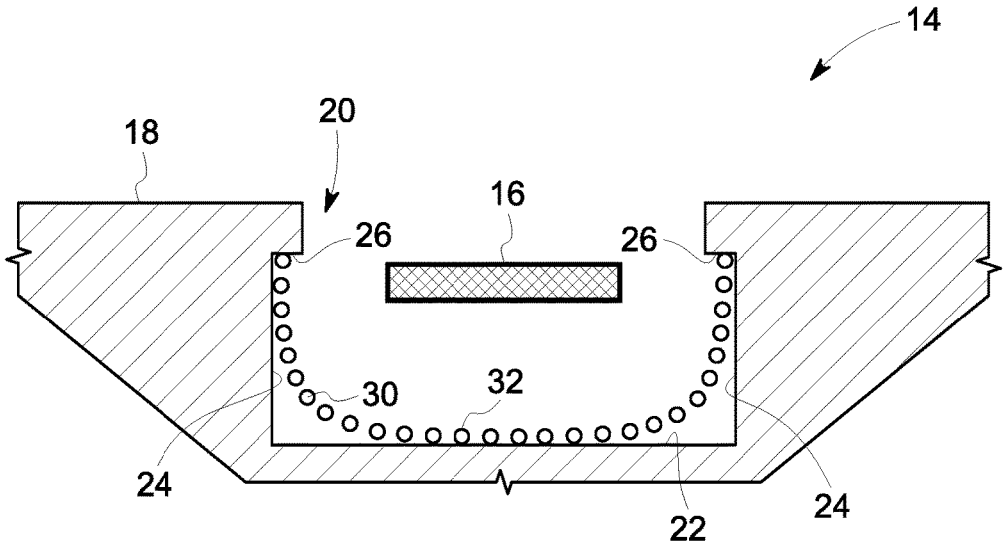
FIGS. 2-5 provide cross-sectional views of various embodiments of cathode cups according to the present disclosure.

The shield 30 may be formed of any material capable of withstanding the high temperatures and temperature fluctuations that occur at an electron source in an x-ray tube 10. In one embodiment, the shield is made of a refractory metal, such as tungsten, or a tungsten alloy that closely matches the coefficient of thermal expansion of the tungsten material deposited by the emitter. In other embodiments, especially where the shield 30 is a mesh 32, the shield may be made of other high-temperature materials that have a low coefficient of thermal expansion that deviates from that of tungsten, such as Fe-29Ni-17Co (Kovar), Fe-41.5Ni (Ni42), molybdenum, rhenium, and tantalum. The shield 30 may be a foil or other solid or perforated sheet, or it may be a mesh. FIG. 2 depicts one embodiment where the shield 30 is a mesh 32, which may be a wire mesh, for example. The mesh 32 may be made of any various metal materials. In one embodiment, the mesh 32 is comprised of tungsten or other refractory metal that has the same or similar CTE as the deposited material 52.

A mesh or perforated embodiment may have holes or pores through which sublimated material may pass. Any material deposited on the mesh shield 30 will have a low risk of flaking due to the smaller surface area of attachment and due to the various angles at which the deposited material will attach. Moreover, being a separate element with thermal expansion independent of the cathode cup 18, the strain induced by thermal expansion mismatch between the mesh and the emitter material is highly diminished. Further still, in embodiments having the same or similar CTE as the deposited emitter material 52, the thermal expansion mismatch is practically eliminated.

Figure 5:
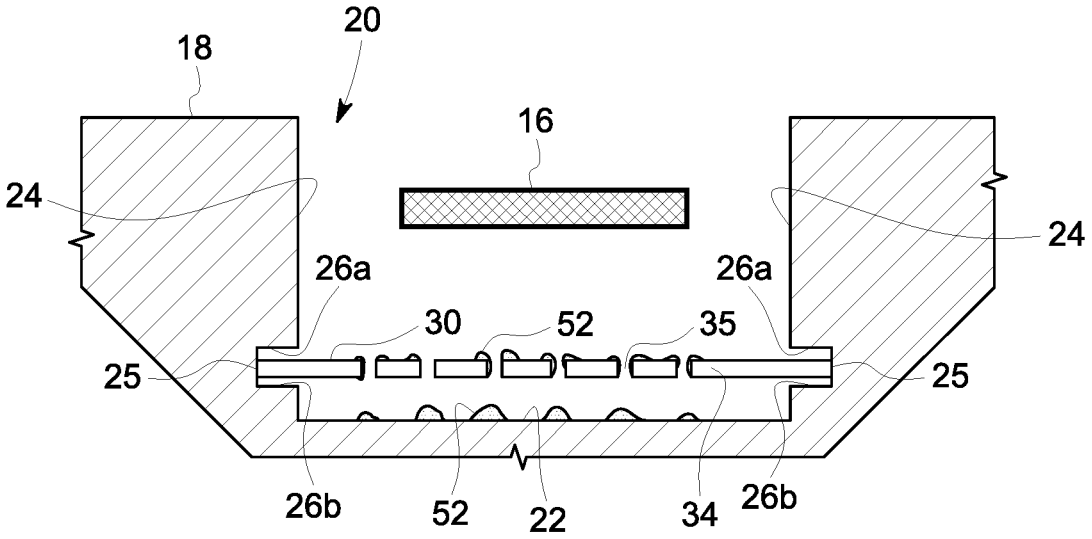

As depicted in FIG. 5 showing a shield 30 that is a perforated foil sheet 34, areas, or "islands," of sublimated emitter material 52 may form underneath the holes or perforations 35 in a mesh 32 or foil sheet 34. These islands of deposited material 52 on the bottom surface 22 of the recess 20 in the cathode cup 18 will have reduced flaking issues than a continuous film formed on the bottom surface 22, which is a problematic aspect of prior art systems as explained above. As shown in FIG. 5, the deposited emitter material 52 that travels through the holes or perforations 35 of the shield 30 will have a graded thickness that becomes progressively thinner at the edges. This solves a problem with the prior art, where the spalling effect is caused by a concentration of shearing forces at the edges of the film of deposited emitter material. The thinner edges of the islands formed under the shield 30 have a lower risk of separating and flaking. Moreover, even if such separation does occur, any flaked material will be prevented from becoming problematic because the shield 30 will retain any flaked material at or below the shield. Accordingly, the shield 30 will prevent any emitter material flakes from touching or otherwise coming to close to the emitter 16, and thus prevent emitter malfunction or degradation caused by the collection of such material.

Figure 3:
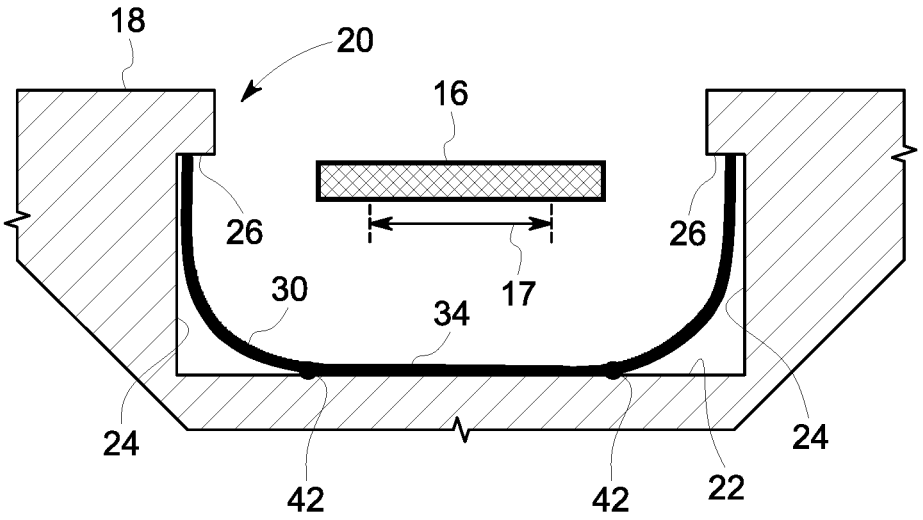
Figure 4:
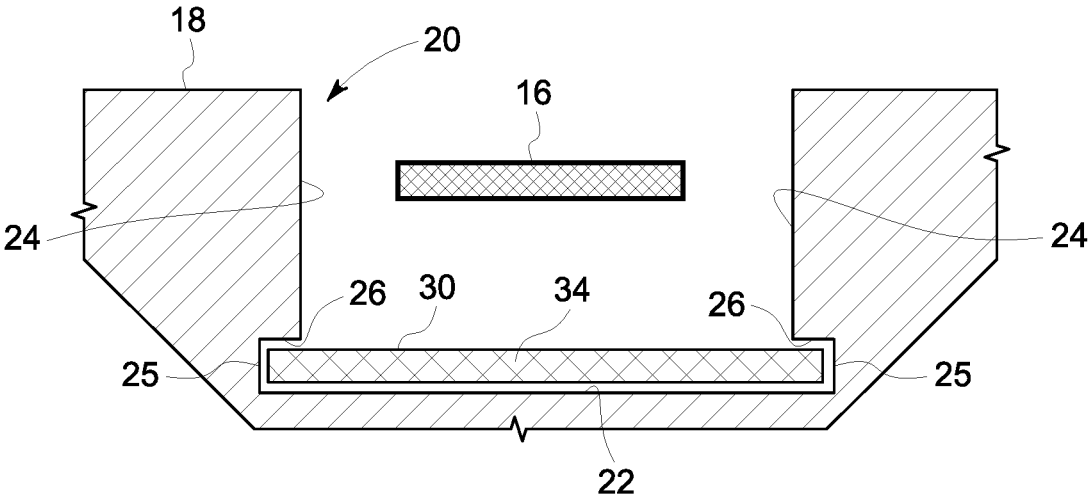

In other embodiments, like that shown in FIGS. 3 and 4, the shield 30 may be a solid sheet of foil 34. In the case of a solid foil 34, it may be more important for the CTE of the foil 34 to be similar to the CTE of the deposited emitter material 52. In such an embodiment, the thermal mismatch between the two materials will be reduced, thus reducing the amount of separation caused by strain between the two materials. Accordingly, the foil 34 may be formed of tungsten or other refractory metal, which may be the same material as the emitter 16 such that the CTE of the shield 30 is the same as or equivalent to that of the deposited emitter material 52.

In the example at FIG. 3, the foil 34 is attached to the bottom surface 22 by welds 42. In the example, the welds 42 are not directly underneath the emission area 17 where heavy deposits of emitter material occur. As will be known to an ordinary skilled person in the x-ray arts, x-ray emitters typically have an emission area 17, which may be a serpentine-like path in a center area of the emitter 16. The deposits under that emission area 17 will be greater, and it may be preferable to provide the welds 42, or other mechanical fixations, outside of the area directly underneath the emission areal?. Alternatively, the welds 42 or other mechanical fixation means 40 may be made of a material with the same or similar CTE as the foil 34 and/or the deposited emitter material 52, and thus any problems caused by thermal mismatch at the attachment point will be mitigated.

As described above, the shield 30 may be a mesh or a foil, which may be a solid foil sheet or a perforated foil. The shield 30 is preferably configured to span at least underneath the emission area 17 of the emitter 16. However, in various embodiments, the shield 30 may be configured to cover some or all of the bottom surface 22 of the recess 20. In various embodiments, the shield 30 may be configured to also span the sidewalls 24 of the recess 20. Thereby, the shield may be positioned between the emitter 16 and the sidewall 24 and will receive and retain any deposited emitter material that is expelled toward the sidewall 24.

In embodiments where the shield extends up the sidewall, such as those depicted in FIGS. 2 and 3, mechanical attachment means 40 may be provided to attach and maintain the shield 30 within the recess 20. In the depicted embodiment, the sidewalls have a ledge 26 that extends perpendicularly inward from the sidewalls 24 and acts as a retaining force against the shield to keep the shield within the recess 20. In other embodiments, the sidewalls 24 may be configured with grooves or recesses that mate with corresponding extensions, grooves, or recesses in the shield 30 (e.g. a swaged ridge or rivet that mates therewith and attaches the shield 30 to a corresponding feature on the sidewall 24). In these various embodiments, the shield 30 may be configured to be dropped into the recess 20 or slid into the recess 20 from the side.

In other embodiments like that depicted in FIGS. 4 and 5, the shield 30 may be a flat sheet, such as a flat mesh sheet or a flat foil sheet configured to cover the bottom surface 22. In various embodiments, the flat sheets may be clipped, screwed, welded, tacked, or otherwise mechanically attached to the bottom surface 22 by any various mechanical fixation elements. In other embodiments, mechanical fixation within the recess 20 may be provided by grooves 25 in the sidewalls 24 and/or in the bottom surface 22.

The shield 30 may contact the bottom surface 22 or may be suspended above it. For example, as depicted in FIGS. 4 and 5, the shield 30 may be configured to slide into grooves 25 in the sidewalls 24 of the recess 20, and to be maintained within the recess 20 by the ledges 26. In certain embodiments, the grooves 25 may be configured to maintain the shield 30 directly on the bottom surface 22 of the recess 20 such that the shield 30 contacts the bottom surface 22. In other embodiments, the grooves 25 are configured to suspend the shield 30 above the bottom surface 22 such that a gap exists between the shield 30 and the bottom surface 22. An example of such embodiment is depicted in FIG. 5. The grooves 25 have a top ledge 26*a* that exerts force on the shield to prevent the shield 30 from moving toward the emitter 16, and a lower ledge 26*b* that exerts force in the opposite direction of the upper ledge 26*a* and suspends the shield 30 above the bottom surface 22. Such an embodiment may be particularly useful where the shield 30 is a mesh 32 or perforated foil 34, such that that sublimated emitter material 52 can fall through the perforations 35 or holes in the shield 30. Thereby, the shield 30 can maintain the deposited emitter material 52 away from the emitter 16, as is described above. In other embodiments, the shield 30, or at least a portion thereof, may be suspended above the bottom surface 22 by other means, such as by rivets or feet on a bottom side of the shield 30 or protruding aspects extending upward from the bottom surface 22.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

We claim:

1. An x-ray tube comprising:

an electron emitter;

a cathode cup having a recess that holds the electron emitter, the recess having a bottom surface;

a shield positioned in the recess between the electron emitter and the bottom surface, wherein the shield is configured to receive deposited sublimated emitter material and to maintain the sublimated emitter material away from the electron emitter; and wherein the shield is comprised of a refractory metal material having a coefficient of thermal expansion that is equivalent to that of the sublimated emitter material.

2. The x-ray tube of claim 1, wherein the shield is held within the cathode cup by at least one mechanical fixation means.

3. The x-ray tube of claim 2, wherein the mechanical fixation means includes at least one of a clip, a screw, a tack, a weld, a rivet, a friction fitting, and a ledge or a groove in a sidewall of the recess.

4. The x-ray tube of claim 1, wherein the shield is one of a mesh or a foil mechanically attached to the cathode cup.

5. The x-ray tube of claim 4, wherein the shield is a tungsten mesh.

6. The x-ray tube of claim 4, wherein the shield is a tungsten foil.

7. The x-ray tube of claim 1, wherein the cathode cup includes at least one groove on a sidewall of the recess, and wherein the shield is inserted into the groove and is held in place within the recess by the groove.

8. The x-ray tube of claim 7, wherein the shield is a flat mesh sheet or a flat foil sheet inserted into the groove.

9. The x-ray tube of claim 1, wherein at least a portion of the shield is suspended above the bottom surface of the recess.

10. A cathode cup for an x-ray system, the cathode cup comprising:

a recess for holding an electron emitter, the recess having a bottom surface that faces the electron emitter when the electron emitter is held in the recess;

a shield positioned between the electron emitter and the bottom surface of the recess, wherein the shield is configured to receive deposited sublimated emitter material and to maintain the sublimated emitter material away from the electron emitter; and wherein the shield is comprised of a refractory metal material having a coefficient of thermal expansion that is equivalent to that of the sublimated emitter material.

11. The cathode cup of claim 10, wherein the shield is comprised of one of a mesh and a foil mechanically attached to the cathode cup.

12. The cathode cup of claim 11, wherein the shield is comprised of one of a tungsten mesh and a tungsten foil.

13. The cathode cup of claim 10, further comprising at least one groove on a sidewall of the recess, and wherein the shield is inserted into the groove and is held in place within the recess by the groove.

14. The cathode cup of claim 13, wherein the shield is a mesh sheet or a foil sheet inserted into the groove.

15. The cathode cup of claim 10, wherein at least a portion of the shield is suspended above the bottom surface of the recess.

16. The cathode cup of claim 10, wherein the recess has at least one sidewall, and wherein the shield is further positioned between the electron emitter and the sidewall.

* * * * *